US006594834B2

(12) United States Patent
Fenty et al.

(10) Patent No.: US 6,594,834 B2
(45) Date of Patent: Jul. 22, 2003

(54) LOVESEAT/BABY CRIB

(76) Inventors: Andre' D. Fenty, 20 Colonial Dr., Groton, CT (US) 06340; Charmaine K. Fenty, 20 Colonial Dr., Groton, CT (US) 06340

( * ) Notice: Subject to any disclaimer, the term of this patent is extended or adjusted under 35 U.S.C. 154(b) by 11 days.

(21) Appl. No.: 09/824,063

(22) Filed: Apr. 3, 2001

(65) Prior Publication Data

US 2001/0049842 A1 Dec. 13, 2001

Related U.S. Application Data

(60) Provisional application No. 60/194,052, filed on Apr. 3, 2000.

(51) Int. Cl.[7] ..... A47D 7/00

(52) U.S. Cl. ..... 5/93.2; 5/2.1; 5/100; 297/10; 297/440.23

(58) Field of Search ..... 5/93.2, 100, 2.1; 297/9, 440.23, 10, 12

(56) References Cited

U.S. PATENT DOCUMENTS

| | | | | | |
|---|---|---|---|---|---|
| 8,468 | A | * | 10/1851 | Knowles | 297/10 |
| 743,495 | A | | 11/1903 | Hanley | |
| 1,391,566 | A | * | 9/1921 | Musselman | 5/100 |
| 2,369,552 | A | | 2/1945 | Ferran | |
| 4,361,919 | A | | 12/1982 | Hull | |
| 4,672,698 | A | * | 6/1987 | Sands | 297/423.28 |
| 4,811,436 | A | | 3/1989 | Schwartz | |
| 4,823,415 | A | * | 4/1989 | Lampard | 5/100 |
| D316,339 | S | | 4/1991 | Taylor | |
| 5,146,631 | A | * | 9/1992 | Deal | 5/183 |
| 5,173,974 | A | | 12/1992 | Proano et al. | |
| 5,528,785 | A | | 6/1996 | Petrus | |
| 5,604,941 | A | | 2/1997 | Roman | |
| 5,699,569 | A | | 12/1997 | Schwarz-Zohrer | |
| 5,715,551 | A | | 2/1998 | Proano et al. | |

FOREIGN PATENT DOCUMENTS

| | | |
|---|---|---|
| GB | 1 344 438 | 1/1974 |

* cited by examiner

*Primary Examiner*—Heather Shackelford
*Assistant Examiner*—Lisa M Saldano
(74) *Attorney, Agent, or Firm*—Richard C. Litman

(57) ABSTRACT

An article of furniture which is readily convertible from a loveseat to a baby crib and vice versa. The loveseat/baby crib includes two main parts: a mattress supporting assembly and a frame assembly. The frame assembly includes a pair of side end panels, a vertically movable front side rail, and an immobile rear rail disposed between the panels. The mattress supporting assembly has a drawer for storing the baby crib mattress. A vertical sliding assembly connects the frame assembly to the mattress supporting assembly. The vertical sliding assembly allows the frame assembly to be height adjustable with respect to the mattress supporting assembly. The movable front side rail can be stored in the rear of the rear side rail in another embodiment by modifying the two rails.

12 Claims, 9 Drawing Sheets

LOVESEAT/BABY CRIB

CROSS-REFERENCE TO RELATED APPLICATION

This application claims the benefit of U.S. Provisional Patent Application Ser. No. 60/194,052, filed Apr. 3, 2000.

BACKGROUND OF THE INVENTION

1. Field of the Invention

The present invention relates generally to furniture, and more specifically to a novel loveseat design which is rapidly and reversibly convertible from a love seat to baby crib.

2. Description of Related Art

Numerous articles of furniture have been devised for multifunctional use. Some of the most significant advances in the art have centered around convertible and modular furniture. However, none of the references herein described presents a piece of furniture which can be converted to either a loveseat or a baby crib through the use of a vertically extensible, one-piece frame and a removable, adjustable safety side rail.

U.S. Pat. No. 5,715,551, issued on Feb. 10, 1998 to Lou Proano et al., describes an article of furniture which may be configured in the form of a crib, a youth bed, or an adult bed, wherein the crib structure is produced through the employment of a rear panel, a right side panel, a left side panel, a front panel, and a first mattress support frame. The front panel comprises a stabilizer bar and a gate. The gate is movable to permit greater access to the confines of the crib. The crib is convertible to a youth bed by rearranging and/or eliminating components forming the gate and stabilizer bar. The gate or stabilizer bar may also be arranged to form a roll bar to prevent a slumbering toddler from rolling off the edge of the mattress.

U.S. Pat. No. 5,699,569, issued on Dec. 23, 1997 to Sabine Schwarz-Zohrer, describes a combined bed and seat device for an infant comprising a base for supporting an infant, a first inflatable cushion secured to and surrounding the base, a second inflatable cushion having a forward section secured to the first inflatable cushion, and an inflatable bellows-type wall member disposed between the first and second cushions.

U.S. Pat. No. 5,146,631, issued on Sep. 15, 1992 to Harry Deal, describes a convertible assembly for providing a crib, a toddler bed, or a twin bed arrangement, and alternatively, a pair of twin or bunk beds. A pair of headboard and footboard assemblies each have separable upper and lower sections mounted together though coupling hardware to provide a crib assembly having one stationary crib side rail and one drop side rail.

U.S. Pat. No. 5,173,974, issued on Dec. 29, 1992 to Lou Proano et al., describes an article of furniture which is convertible to a crib, a youth bed or an adult bed. The crib is produced through the interconnection of a rear panel, a right side panel, a left side panel, a front panel, and a mattress support frame. This interconnection of parts provides a substantially rectangular configuration having the mattress support frame horizontally disposed therein. The front panel is comprised of at least a lower section and an upper gate section. The upper access gate section permits greater access to the confines of the crib. The crib may be converted to a youth bed through the removal of the upper gate section and the downward vertical displacement of the mattress support frame. The lower section functions as a roll bar to prevent a toddler from rolling off the edge of a mattress. The roll bar may be eliminated by inverting the lower section. The youth bed is convertible to an adult bed by replacing the mattress support frame and the right and left side panels with independent right and left front upright members. The right and left front upright members are, respectively, attachable to right and left edges of the lower section, and the right and left bed rails. The rear panel defines a headboard, and the lower section defines a foot board of the adult bed. An optional extension is attachable to the headboard to provide a headboard which is more aesthetically appealing to its user.

U.S. Pat. No. 5,528,785, issued on Jun. 25, 1996 to Tami L. Petrus, describes a confining device couch converter for converting a seat cushion into a confining device for a resting baby. The confining device includes a flat sheet portion for covering a portion of the seat cushion where the baby rests. A wedge positioned along a perimeter of the sheet portion also provides a barrier so that the baby does not fall onto the floor. An attaching portion connects the sheet portion to the seat cushion so that the confining device is secured to the seat cushion.

U.S. Pat. No. 5,604,941, issued Feb. 25, 1997 to Edward Roman, describes a portable crib for a sofa, including a front section comprising an inner gate and an outer gate. The inner gate is slidably received within the outer gate. The apparatus includes a pair of side sections, each comprised of an inner gate and an outer gate; and these inner gates are also slidably received within the outer gate. A sofa securement mechanism is hingedly coupled with the inner gate and outer gates of the front section U.S. Pat. No. 4,811,436, issued on Mar. 14, 1989 to Leo Schwartz, describes a child crib with a displaceable and storable slide gate comprising a head and foot frame. A mattress is supported between the frames, wherein each of which has opposed vertical side edge members. A gate is secured to one side of the mattress between a vertical side edge member of the head and foot frame, and extends above the mattress. Each of the other commonly shared vertical side edge members have a first guide channel extending for a predetermined length thereof, and communicating at a lower end with a second guide channel section extending under the mattress. The gate also has guide members for engaging with the guide channels so that it is displaceable from a position of use to a position of storage beneath the mattress.

U.S. Pat. No. 4,361,919, issued on Dec. 7, 1982 to James R. Hull, describes a convertible child's bed which may be sold in the form of a crib for use by a child when it is very young, and which may subsequently be converted into a standard twin bed as the child becomes older.

U.S. Pat. No. 2,369,552, issued on Feb. 13, 1945 to Herbert E. Ferran, describes an enclosure for use upon the seat of an automobile having a seat member disposed at substantially right angles to a back member. The enclosure includes a substantially rigid front wall and a pair of spaced, substantially rigid end walls, connected to the front wall and extending in the same direction therefrom. The end walls are provided with extensions adapted to be inserted between the seat and back members at the junction thereof, to secure the enclosure upon the seat member, and to prevent its shifting relative to the back member in a direction away from the latter.

U.S. Pat. No. 743,495 issued on Nov. 10, 1903 to Timothy Hanley, describes a combined crib, sofa, and lounge comprising end support legs, end frames hinged to the legs, a rear side frame, and a bottom frame revolvably pivoted at each end to the end frames. Latches are secured to two of the legs, which are adapted to support one side of the bottom frame. Springs for holding the latches in engagement with the bottom frame are also provided.

U.S. Design Pat. No. 316,339, issued on Apr. 23, 1991 to Gwen S. Taylor, describes a portable collapsible crib.

British Patent Application No. 1 344 438, published on Jan. 23, 1974, describes an inflatable carry cot.

None of the above inventions and patents, taken either singly or in combination, is seen to describe the instant invention as claimed.

SUMMARY OF THE INVENTION

The present invention relates to an article of furniture which is readily convertible from a loveseat to a baby crib and back again to a loveseat. The loveseat/baby crib furniture is designed to optimize space within the home of the user, and allowing the baby crib to become a permanent part of the home. The present invention solves a longfelt need by providing a multi-use article of furniture which can be employed in any domestic setting, including hotels, where loveseats are ideal because of their shape and size and the problem of substandard or insufficient furnishings for infants and small children is all too common.

A first embodiment of the loveseat/baby crib furniture includes a mattress supporting assembly and a frame assembly. The frame assembly is designed to be manually vertically extendable or movable with respect to the mattress supporting assembly. The frame assembly comprises a pair of side panels, both of which are upright, planar, and mutually parallel. A permanent side rail is disposed between the panels at their rear ends and coupling means for an adjustable side rail are provided at the front ends of the panels. The generally box-shaped mattress supporting assembly comprises front, back, and two sidewalls. The front wall of the mattress supporting assembly has a generally rectangular-shaped opening for receiving a drawer for storing the baby crib mattress. The superior surface of the front panel of the drawer has a groove for receiving and locking into place the adjustable side rail after being slidably inserted into the coupling means on the side panels. A second embodiment provides for storage of the adjustable side rail by attachment to the rear side rail when the furniture is being used as a loveseat.

Accordingly, it is a principal object of the invention to provide a new article of furniture which is readily convertible to either a loveseat or a baby crib through the use of a frame which is attached to a mattress support in a first position for use as a loveseat, and raised to a second position on the mattress support for use as a baby crib, together with a removable, height adjustable, safety side rail.

It is another object of the invention to provide a loveseat/baby crib furniture which is designed to optimize space within the home of the user, allowing the baby crib to become a permanent part of the home, sine it retains utility as a loveseat when its use as a baby crib is no longer required.

It is a further object of the invention to provide a multi-use article of furniture which can be employed in any domestic setting, including hotels.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to an article of furniture which is convertible from a loveseat to a baby crib.

Figure 1:
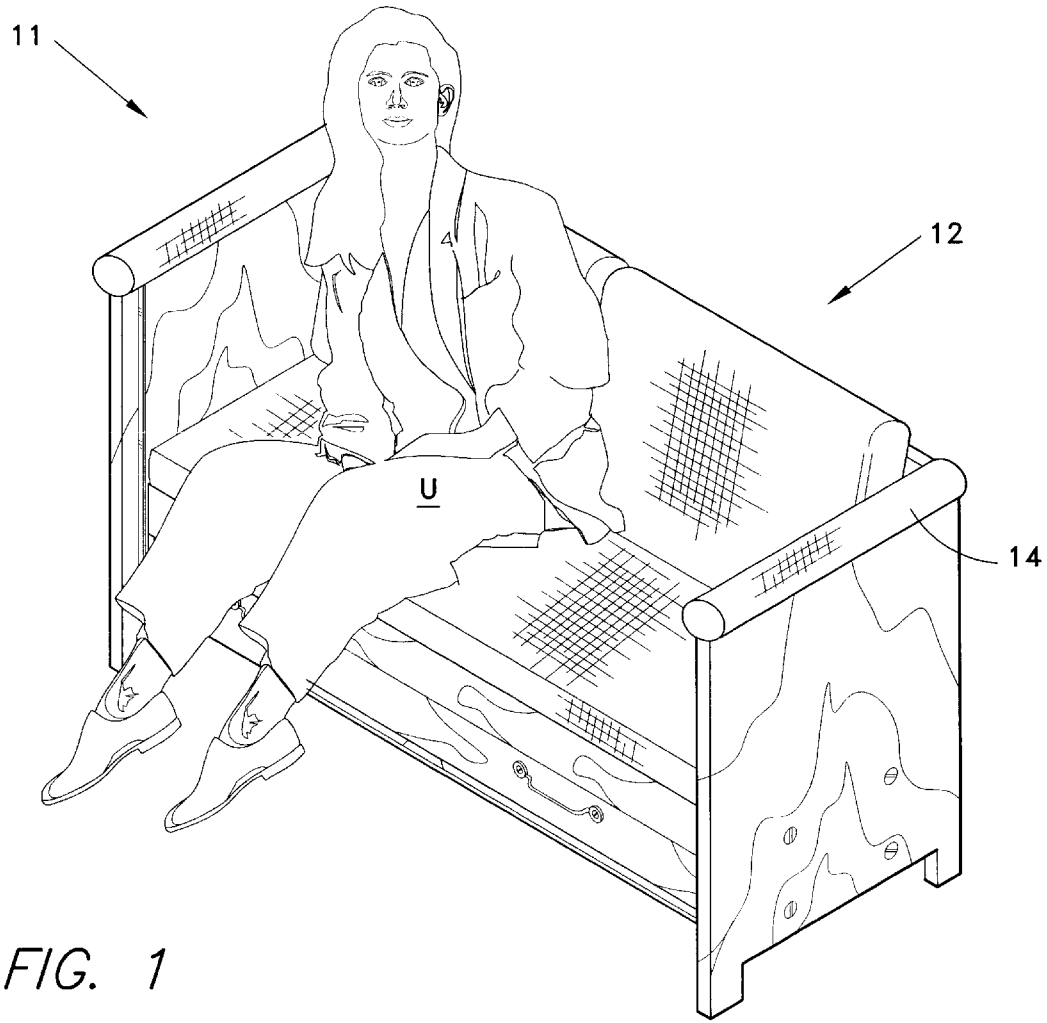
FIG. 1 is an environmental, perspective view of the loveseat/baby crib furniture according to the present invention.

As illustrated in FIG. 1, the loveseat/baby crib furniture 11 is shown provided with pillows 12 and padded arm portions 14 to improve the comfort of the user U, as well as the overall appearance of the invention. However, it should be noted that the styling of the pillows 12 shown in FIG. 1 is exemplary, and that this specification embraces the use of any and all styles for cushions, pillows, arm covering, or padded portions such as commonly known in the art and in conventional use.

Alternatively, the entire invention can be used as the interior support frame for a comprehensive padded covering to give the invention the appearance of a small couch. In short, any styles, cushioning means or decorative motifs can be used with the inventive concept, wherein the arms and back portion of a loveseat are vertically extended to form the sides and back of a baby crib. Additionally, in a preferred embodiment, the crib mattress is stored in a drawer incorporated in the present invention.

The ability of the invention to store and to have articles stored within it is an important advantage. The loveseat/baby crib furniture 11 is designed to optimize space within the home of the user U, and allowing the baby crib to become a permanent part of the home. As families become smaller and new families are forced to live in increasingly cramped conditions, convertible furniture becomes more important. The present invention solves a longfelt need by providing a multi-use article of furniture which can be employed in any domestic setting, including hotels, where the problem of substandard or insufficient furnishings for infants and small children is all too common. Furthermore, the inventive apparatus can be broken down into its component parts, allowing for easy assembly and disassembly. Thus, a simple and economic solution to the old problem of what to do with the baby's crib when it is no longer needed is provided.

Figure 2:
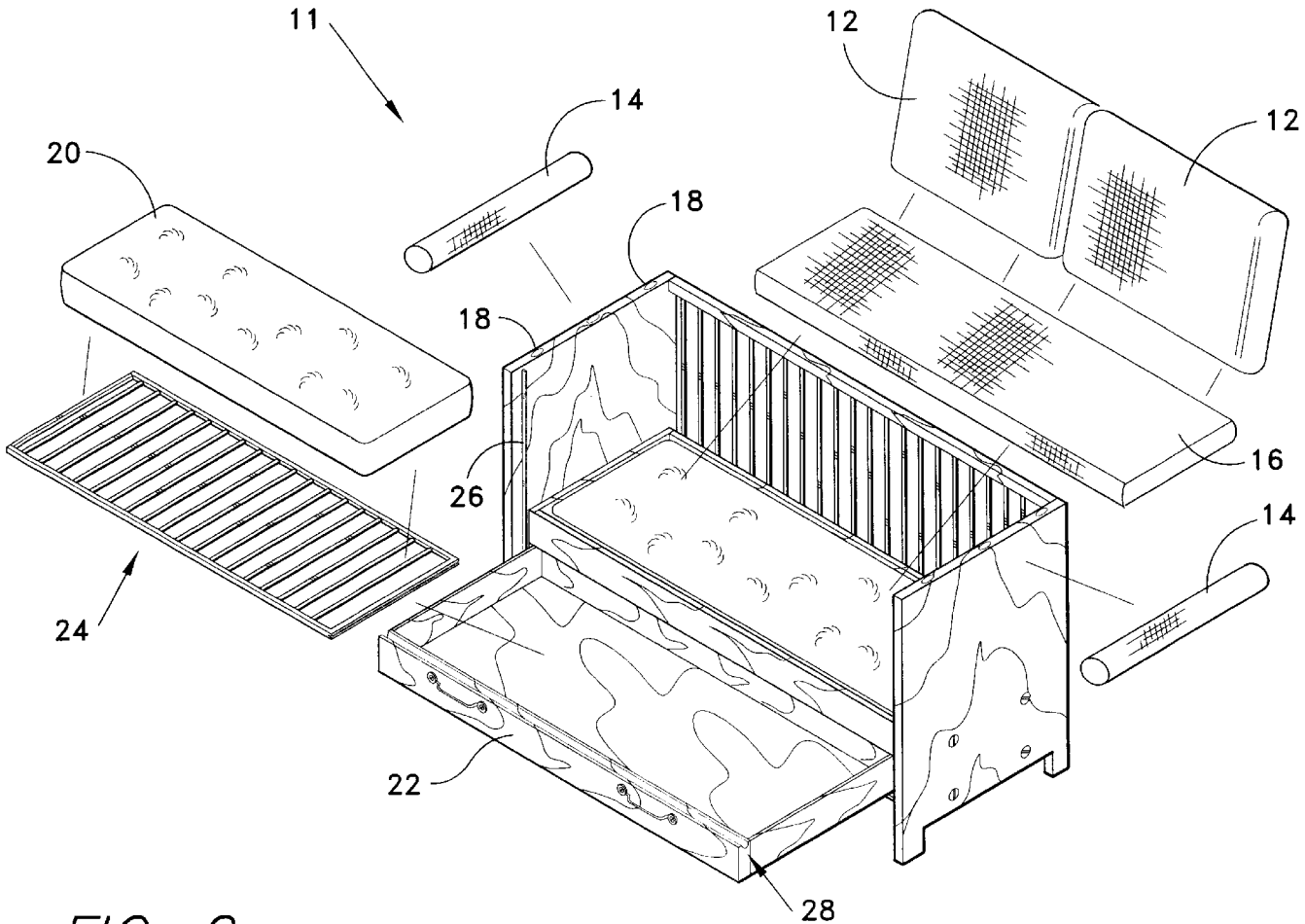
FIG. 2 is a perspective, exploded view of the loveseat/baby crib furniture, according to a first embodiment of the present invention.

Turning now to FIG. 2, there is shown an exploded view of a first embodiment of the invention, in which the relationship of the various parts of the loveseat/baby crib 11 is more clearly seen, including the two back pillows 12 for placement against the back rail, the seat cushion 16 for placement on the mattress supporting portion, and the padded arm rests 14 for attachment by hook and loop fastening 18 to the arms or side panels 34 of the assembly. The crib mattress 20, which is used when the invention is employed as a crib, is shown removed from the drawer 22 in which it is stored. When used as a crib, the adjustable side rail 24 (sometimes referred to as a gate or drop rail) is attached to the loveseat/baby crib 11 by coupling means 26, and locked into a predetermined height by abutment against the horizontal groove 28 defined in the face plate of the drawer 22.

Figure 3:
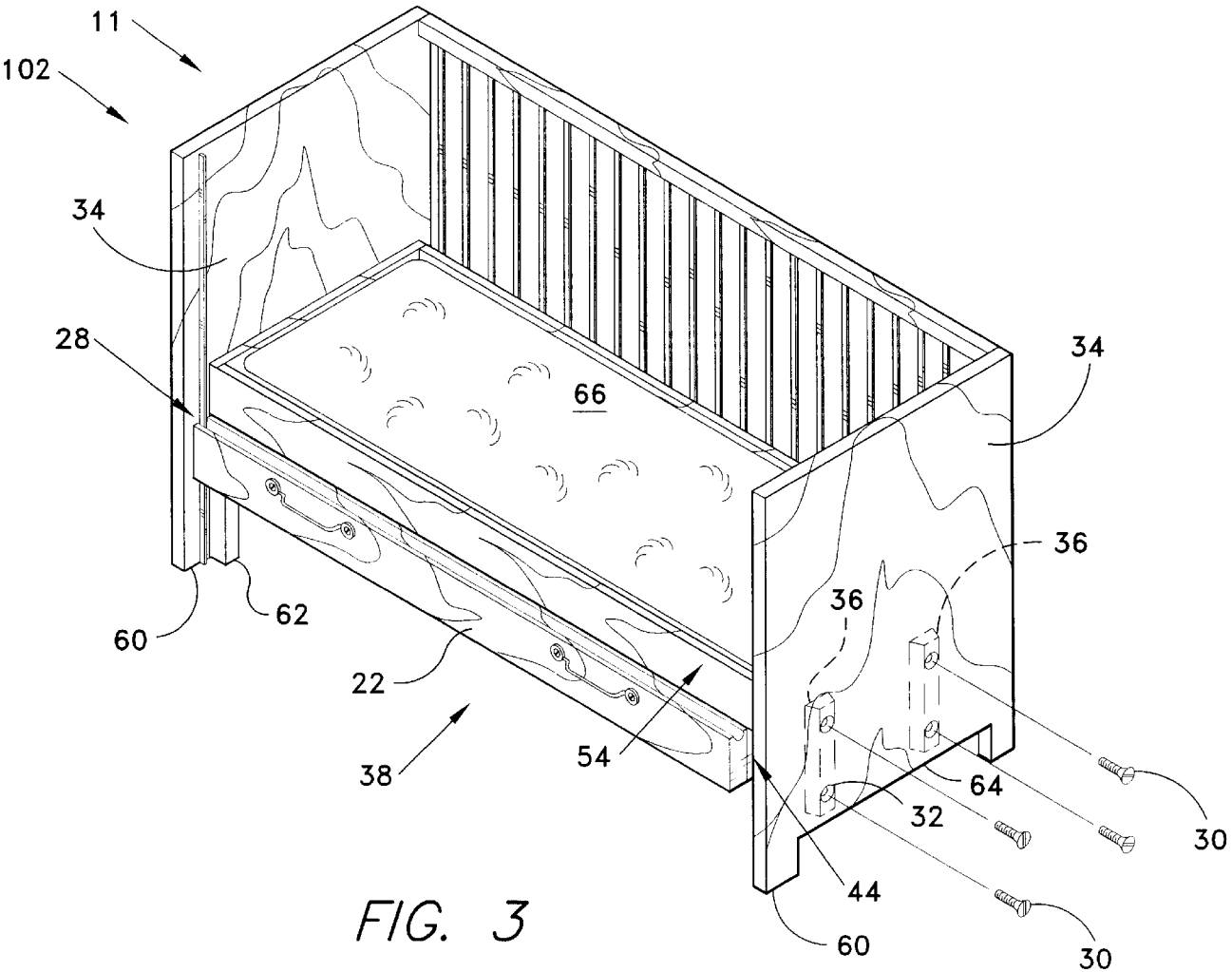
FIG. 3 is a front perspective view of the loveseat/baby crib furniture, showing the removal of the side panel screws in preparation for vertically extending the frame assembly, according to the present invention.

Referring to FIG. 3, a front perspective view of the loveseat/baby crib 11 is depicted in the love seat configuration 102, and shows the invention being prepared to be moved to its extended position for use as a baby crib by removal of the four panel screws 30 which are insertable though apertures 32, disposed on both side panels 34 to securely fasten the frame of the invention to the seat of the invention, i.e., the mattress supporting assembly 38 having legs 62. Male dove-tail sliding element portions 36 attached to the inside surface of side panels 34 and which register with slots defined on the side walls of the mattress supporting assembly 38 are shown in shadow lines, indicating the location of the vertical sliding assembly or registration means of the invention. The side panels 34 have legs 60 separated by edge 64. The vertical sliding assembly provides a simple and efficient way in which the invention can be manually converted from its loveseat configuration to its baby crib configuration and vice versa.

Figure 4:
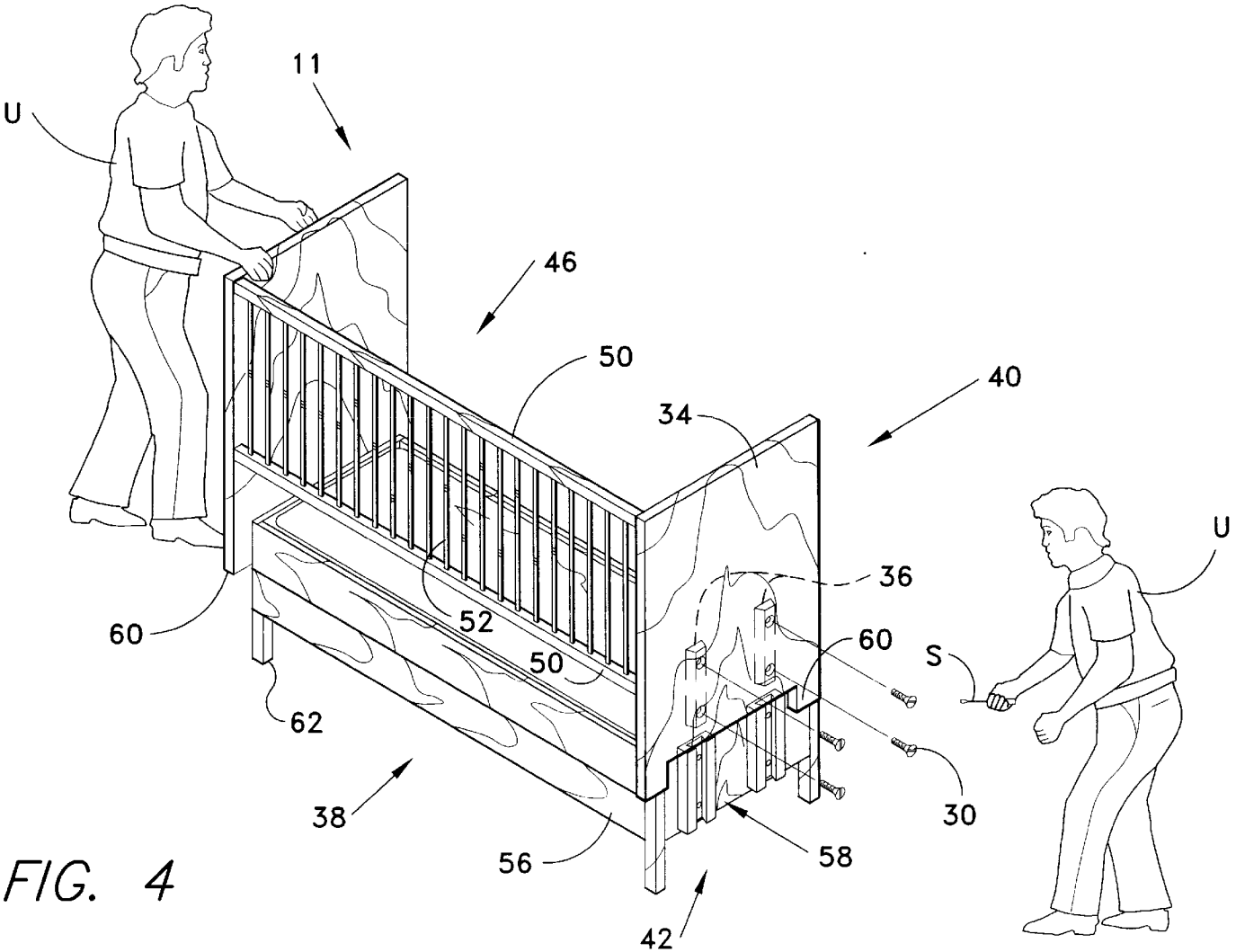
FIG. 4 is an environmental perspective view showing two persons in the process of extending the frame assembly vertically to convert of the loveseat configuration to the baby crib configuration according to the present invention.
Figure 5:
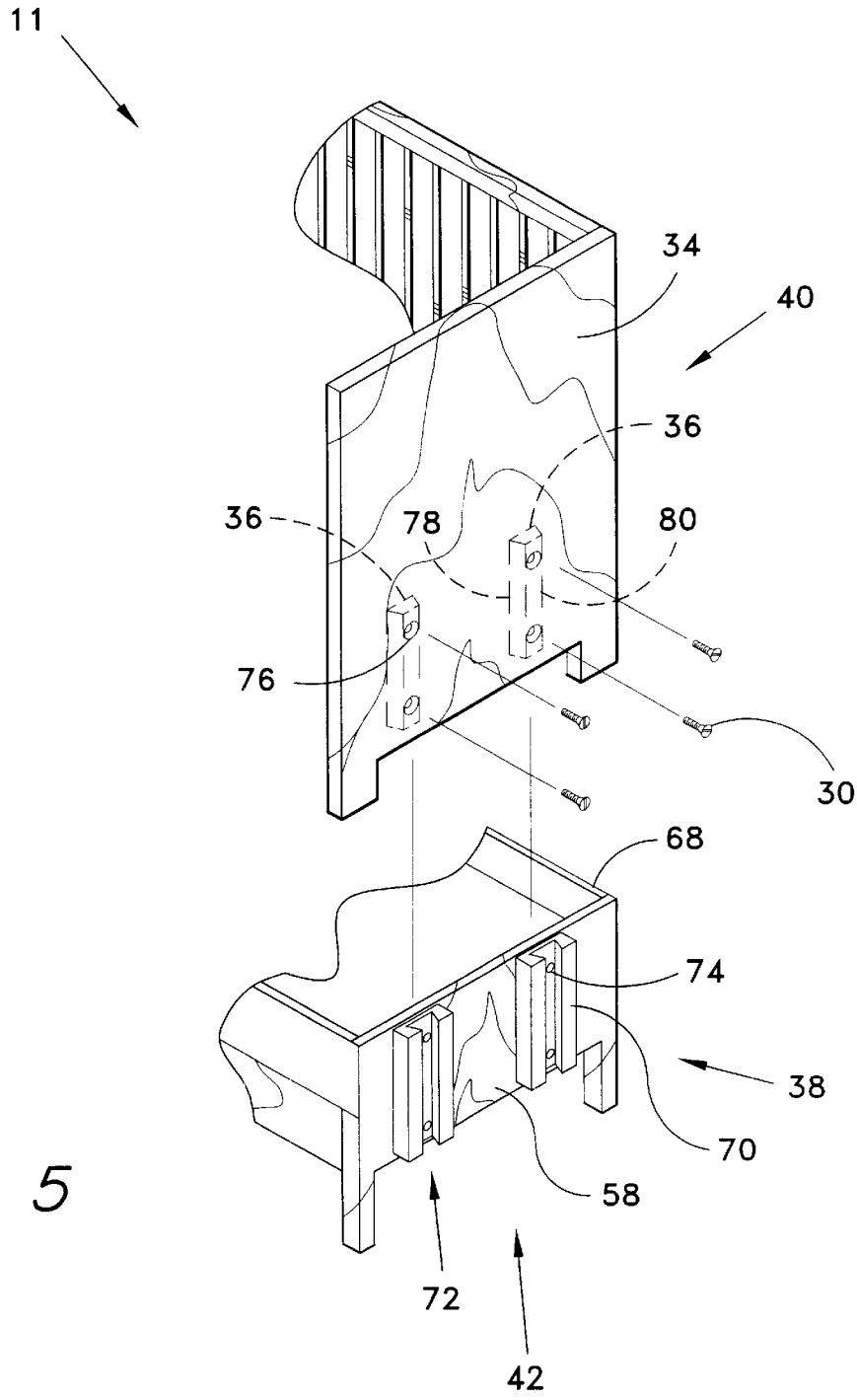
FIG. 5 is a fragmented, exploded, side perspective view of the vertical sliding assembly, according to the present invention.

As best seen in FIGS. 4 and 5, the loveseat/baby crib 11 includes two main parts, i.e., a mattress supporting assembly 38 and a frame assembly 40. The frame assembly 40 is designed to move straight up and down in register with the mattress supporting assembly 38 to preselected heights, and is preferably maintained at those heights by reinsertion of the screws 30 into the vertical sliding assembly 42 by one user U using a screwdriver S (FIG. 4). In alternative embodiments of the invention, the frame assembly 40 can be selectively adjustable to a plurality of different heights, depending on the needs of the user and the age of the infant.

Figure 7:
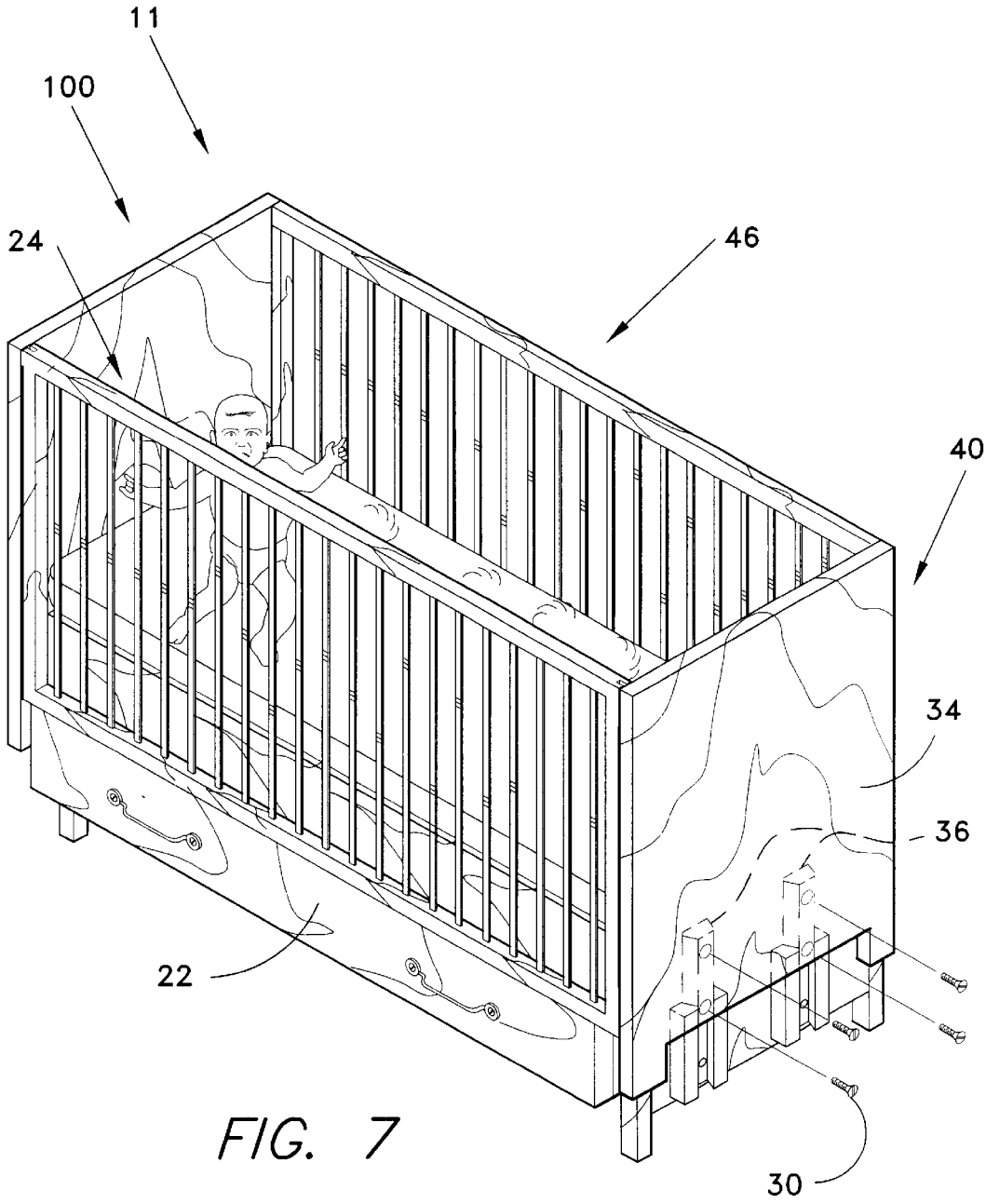
FIG. 7 is an environmental perspective view of the loveseat/baby crib, the adjustable side rail being shown in normal position for use as a baby crib, according to the present invention.

Comparing FIG. 3, which shows the article of the invention in its first or loveseat configuration 102, to FIG. 7, which shows the article in its second or baby crib configuration 100 (after the adjustable side rail 24 has been added), it can be seen that the frame assembly 40 serves as the back and arms of a loveseat when in the first configuration 102, and the back and side walls of a baby crib when in the second configuration 100. This dual utilization of the components of the frame assembly 40 brings an economy of use that fulfills a longfelt need for a baby crib which does not have to be disposed or relegated to storage.

The frame assembly 40, as seen in rear view in FIG. 4, comprises a pair of side panels 34 having legs 60, which are upright, planar, and mutually parallel. A rear side rail 46 is mounted between the panels 34 at their rear end portions. The various parts of the invention can be manufactured with pre-drilled holes for easy assembly and disassembly using any conventional fastening means including nut/bolt assemblies, screw and lager assemblies, and pins of various kinds.

In FIG. 4, the rear side rail 46 comprises a pair of horizontal frame members 50, each normally mounted with respect to the side panels 34 by fasteners (hidden) to form a rectangular shaped support frame for supporting a series of equally spaced apart, vertical slat members 52 extending between the side panels 34. This configuration is exemplary of the arrangement of the constituent components of the side rails 24 and 46, which can comprise any suitably strong and durable assemblage of members sufficient to meet state and federal safety requirements regarding the composition and spacing of slats for baby cribs.

In FIGS. 3 and 4, there is shown the mattress supporting assembly 38, comprising a front wall 54 (FIG. 3), back wall 56 (FIG. 4), and two sidewalls 58 (FIG. 4). The front wall 54 has a rectangular shaped opening 44 for receiving the drawer 22 for storing the baby crib mattress 20.

As seen in FIG. 5, the mattress supporting assembly 38 is preferably a topless box-shaped structure, which in the preferred embodiment of the invention, is also upheld by a leg 62 under each corner, and is designed to receive and hold a cushioning means such as a box spring 66 (FIG. 3) in the superior or top portion thereof, the superior edge of which is indicated at 68 in FIG. 5.

In the preferred embodiment of the invention, a conventional box spring or other cushion supporting means 66 is part of the mattress supporting assembly 38. It should be understood that the invention comprises any mattress or cushion supporting means commonly known in the art and conventionally practiced, including mounted zigzag springs having flexible material coverings or protective material or cloth overlays. However, in alternative embodiments of the invention, a cushion supporting means or box spring 66 can be entirely absent, the top of the assembly 38 being comprised of a removable or permanent solid planar surface for placing the mattress 22 thereon.

In FIG. 5, the mattress supporting assembly 38 is connected to the frame assembly 40 by vertical registration means to allow the frame assembly to move vertically in correct alignment or proper relative position, with respect to the mattress supporting assembly 38 while still remaining attached to it. In the preferred embodiment of the invention the registration means is a dove-tailed, vertical sliding assembly 42. Each of the dove-tail assemblies 42 comprises a male dove-tail mating half or dove-tail portion 36 (in shadow lines) and a dove-tail coupling member 70 adapted to allow the dove-tail portion 36 to be slidably mounted therein.

Thus, the dove-tail portions 36 are attached to the inner surface of a frame assembly side panel 34, and its corresponding dove-tail coupling members are attached to the sidewall 58 of the mattress supporting assembly 38 as shown. The dove-tail coupling member 70 has a central channel or groove 72, into which the dove-tail portions 36 fit to snugly slide up and down, carrying the frame assembly 40 along with it during vertical extension of the apparatus.

Centrally disposed through the dove-tail coupling members 70 and the sidewall 58 are a plurality of apertures 74, which correspond in number, size, and spatial distribution to mating apertures 76, disposed through the dove-tail portions 36 and their supporting side panels 34. The apertures 74 and 76 are adapted to insertably receive screws 30, wherein the number of apertures 74 and 76 provides for a plurality of height adjustments for the frame assembly 40. The vertical channels or grooves 72 are generally trapezoidal-shaped, and are preferably incorporated, formed or molded into the inner surface of the dove-tail coupling members 70.

Each male dove-tail portion 36 has, in cross-section, a free end 78 and an attachment end 80. The attachment end 80 is adapted for reversibly attaching to the inner surface of the side panel 34 with the free end 78 being wider than the attachment end 80. The groove 72 is adapted for snugly receiving one of the free ends 78 of the dove-tail portion 36. The dove-tail vertical sliding assembly 42 allows the frame assembly 40 to slidably engage with the mattress supporting assembly 38.

In a preferred embodiment of the invention, the major structural parts, including side panels 34, rear side rail 46, back wall 56, side walls 58, and drawer 22 of the mattress supporting assembly 38 and the frame assembly 40, are made of wood; but, in alternative embodiments of the invention, other materials such as plastic or light metals such as aluminum can be used. Furthermore, it should be emphasized that, in alternative embodiments of the invention, the specification envisions any other registration means (for connecting together the frame 40 and mattress supporting 38 assemblies) commonly known in the art including, but not limited to, tongue-and-groove or any similar channeling and reciprocal protuberance assembly. Also, it is preferable that the dove-tail mating assembly 42 be made of a strong and durable material such as steel or wood and be sized so as to insure a close abutting relationship between the two assemblies, 38 and 40, to prevent excessive space therebetween.

The conversion of the apparatus from its loveseat configuration 102 to its baby crib configuration 100 is obtained as follows. First, the various pillows of the loveseat configuration are removed, i.e., back pillows 12, padded arm portions 14, and seat cushions 16. Then the screws 30 are removed as in FIG. 3. In FIG. 4, the user U on the left manually pulls the frame assembly 40 upwards by grabbing onto its upper portion, and the screws 30 are simply reattached through the use of a screwdriver S by the user U on the right. Thus, this invention discloses a unique adjustable means to achieve selective heights such as lower, intermediate, and upper levels, depending on the needs of the user.

Figure 6:
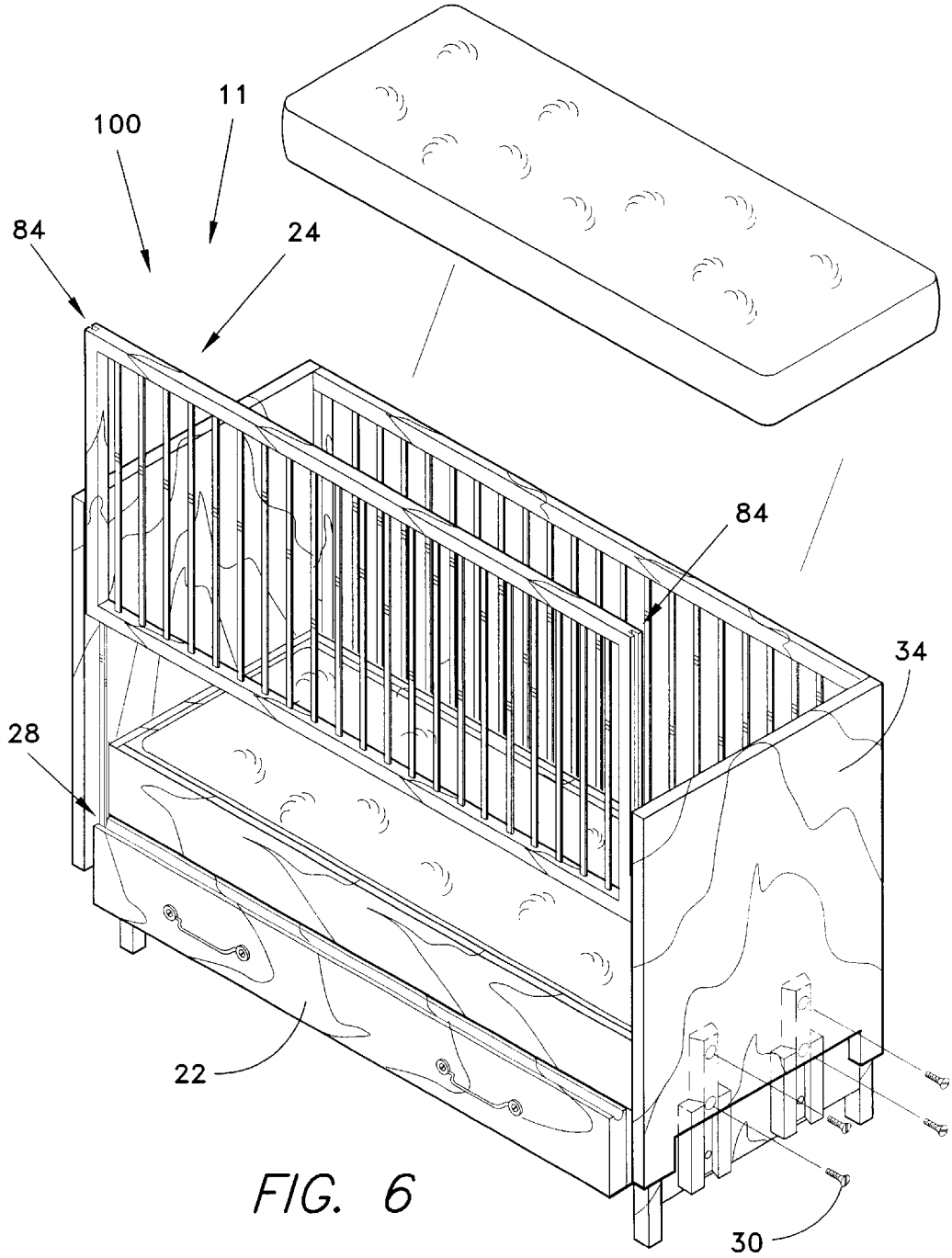
FIG. 6 is a front, partially exploded, perspective view of the loveseat/baby crib furniture, showing the sliding attachment of the adjustable side rail and the placement of the mattress into the crib, according to the present invention.

FIG. 6 shows the adjustable side rail 24 and mattress 20 being added back and completing the modification to the crib configuration 100. The crib 100 can be converted back again to the loveseat 102 by simply reversing the steps. The conversion from the crib 100 back again to the loveseat 102 can be accomplished simply by removing the screws 30 and lowering the frame assembly 40 to the floor.

Figure 8:
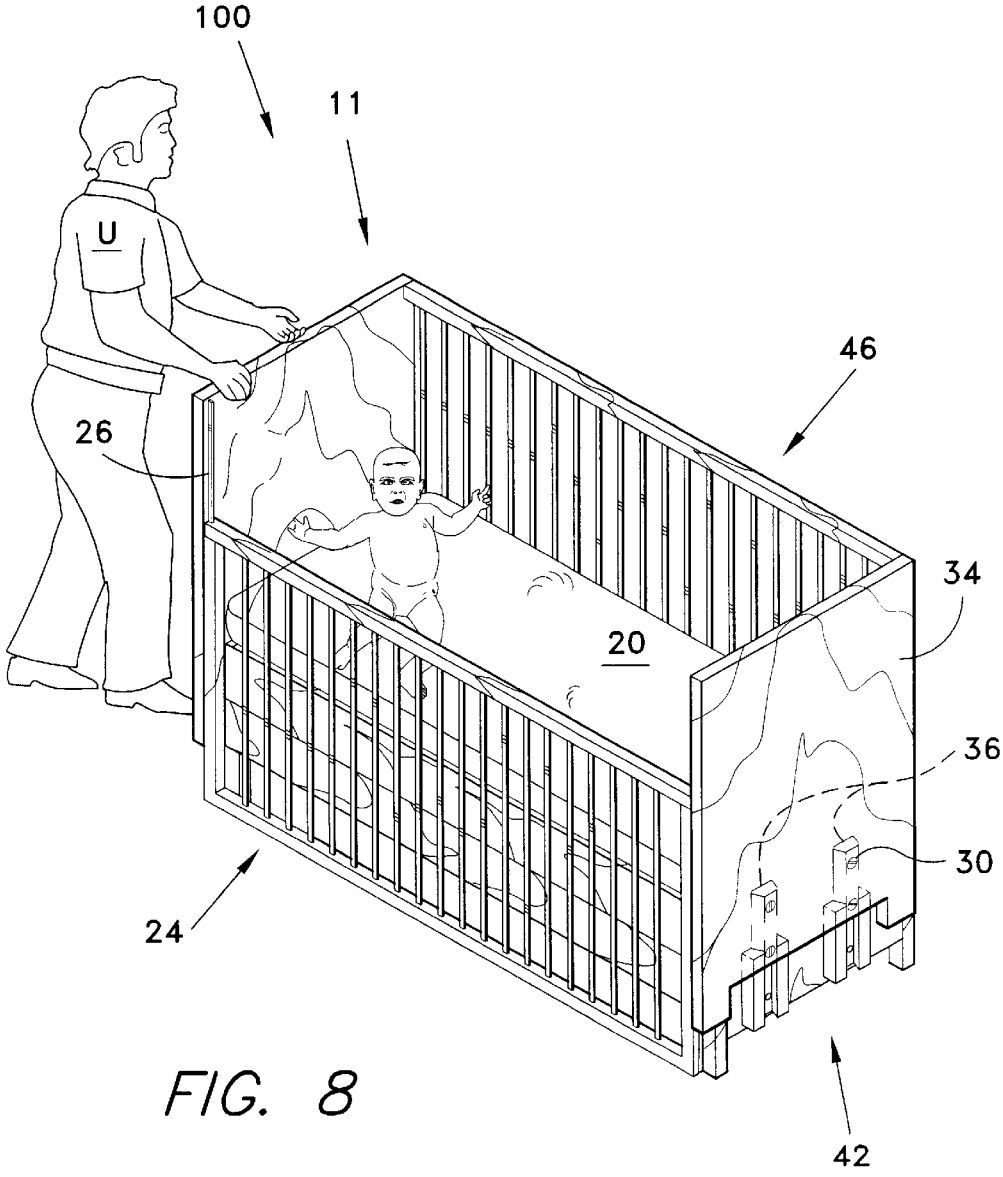
FIG. 8 is an environmental perspective view of the loveseat/baby crib, showing the side rail lowered, according to the present invention.

Referring now to FIGS. 6–8, the adjustable side rail coupling means or vertical ridge 26 serves as a trackway for the adjustable side rail 24, which is adapted to be insertably and slidably mounted on the coupling means 26 over cooperating grooves 84. This specification covers any coupling means 26 conventionally known in the art, including multiple cooperating tracks and grooves, gripping rails, or fasteners of any kind.

FIG. 6 further shows the drawer 22 of the mattress supporting frame 38 pulled out to a position where it is able to receive the adjustable side rail 24 in the horizontal groove 28 disposed on the superior surface of its front panel, serving as a surface of abutment and to lock the adjustable side rail 24 safely into place, substantially as shown in FIG. 7. The present invention is an improvement in the art of adjustable, safety side rails as the use of the drawer 22 as an abutting surface makes it practically impossible for the adjustable side rail 24 to be lowered unintentionally. If the user U wishes to gain access to the interior of the crib, all that is required is to lift the safety rail from its groove 28 and push the storage drawer 22 into the mattress supporting assembly 38, whence the adjustable side rail 24 will naturally be lowered to the floor, as a consequence of manual pressure or gravity, as shown in FIG. 8. The specification additionally comprises all means commonly known in the art for locking the adjustable side rail 24, such as spring-loaded biasing levers.

Figure 9:
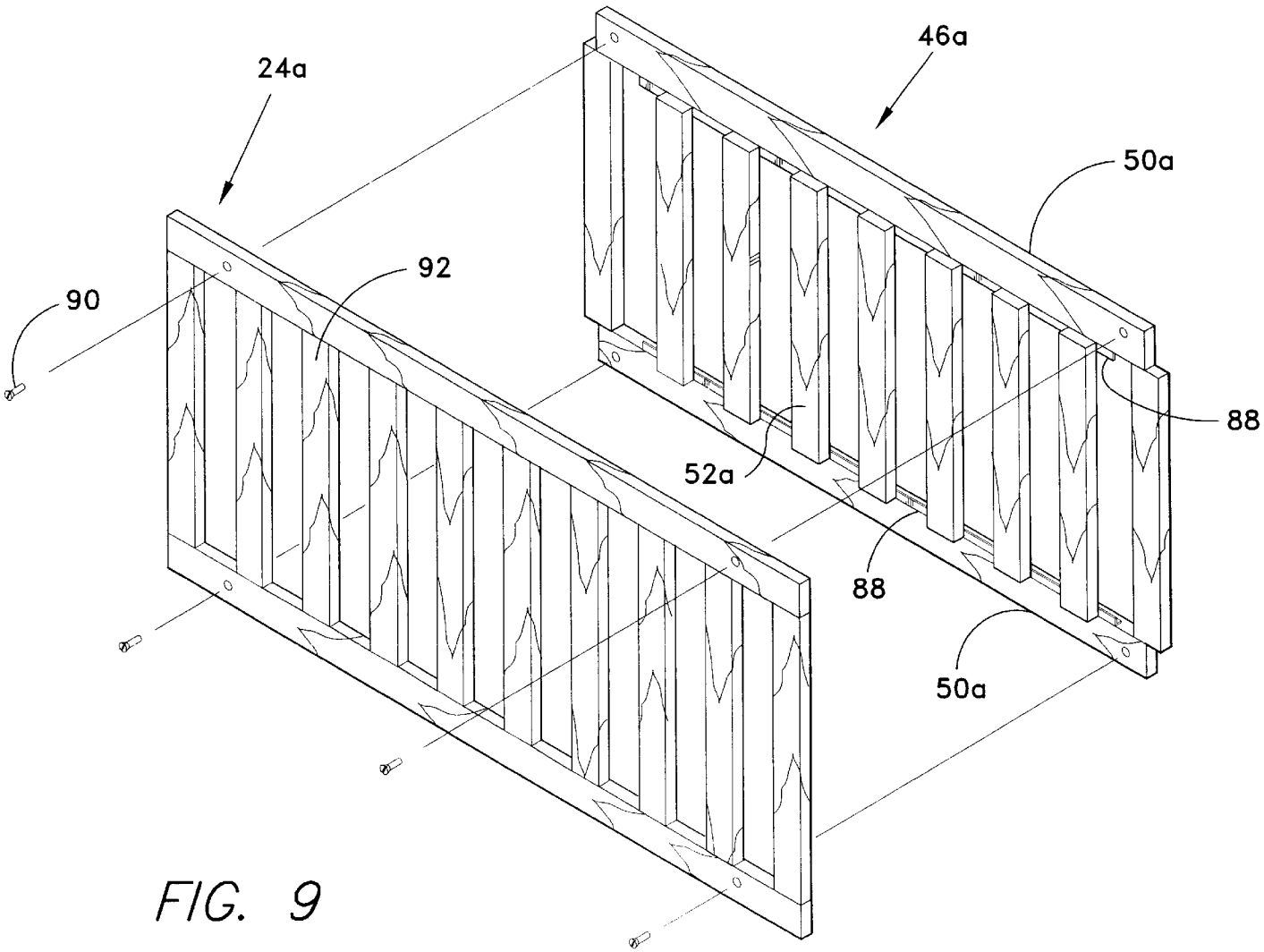
FIG. 9 is an exploded perspective view showing attachment of the front movable gate to the rear of the back side rail for storage in a second embodiment of the present invention, the front part of the frame being omitted for clarity.

In the second embodiment of FIG. 9, the storage of the front movable gate 24*a* on the rear face of the rear frame side rail 46*a* when the when the loveseat/crib 11 is configured as a loveseat is shown. The top rail and bottom rail 50*a* of the rear frame 46*a* have an elongated 90° aluminum bracket or angle 88 attached to their bottom and top surfaces, respectively, with the vertical flange of the angle 88 being flush with the rear face of the top and bottom rails 50*a*. The slats 52*a* are attached to the angles 88 so that the slats 52*a* are offset rearward from the plane of the top and bottom rails 50*a*. The front movable gate 24*a* is fastened by four fasteners 90 in its corners to the rear face of the rear frame side rail 46*a*. The slats 92 of the front movable gate 24*a* are staggered with relation to the slats 52*a* of the rear frame side rail 46*a* so that the slats 52*a* interleave or mesh with the slats 92 of the rear frame side rail 46*a*. This feature in effect strengthens the back of the loveseat 11 embodiment and results in compact storage of the gate 24*a*. All other features of the invention are identical.

In conclusion, the present invention offers a comprehensive solution to the longfelt dilemma many families face (especially young and growing families or families on the road) regarding the optimal usage of floor space, particularly when the baby's crib is no longer needed. An additional benefit of the invention is the provision of an efficient means for storing various parts of the invention not then in use, depending on whether the invention is in the loveseat mode or the baby crib mode. A solution is also provided to insure the safe engagement of crib adjustable side rails, while maintaining their height adjustable function.

It is to be understood that the present invention is not limited to the sole embodiments described above, but encompasses any and all embodiments within the scope of the following claims.

We claim:

1. A convertible article of furniture forming a loveseat or a crib comprising:

a rectangular mattress supporting assembly having a front wall, a back wall, and two side walls connecting the front wall and the back wall;

a U-shaped frame assembly having two parallel rectangular side panels and a rear side rail assembly connecting the two side panels, wherein each of said two side panels has vertical ridges on an inner surface and sliding elements;

registration means for slidably attaching the sliding elements of said side panels of said frame assembly to the side walls of said mattress support assembly and for adjusting the height of the side panels; and a front side rail assembly removably attached to the side panels of said frame assembly;

wherein the convertible article of furniture is configured as a loveseat with said side walls in a first position and with said front side rail removed; and wherein the convertible article of furniture is configured as a baby crib with said side walls in a second position and with said front side rail attached to said frame assembly.

2. The article of furniture according to claim 1, wherein the front wall of said mattress supporting assembly has an opening for a drawer defined therein, the article of furniture further comprising a drawer insertable in said drawer opening.

3. The article of furniture according to claim 2, further comprising:

a box spring disposed on said mattress supporting assembly; and a crib mattress disposed on said box spring.

4. The article of furniture according to claim 3, wherein the crib mattress is capable of being removed from the box spring and stored in said drawer when the article of furniture is configured as a loveseat.

5. The article of furniture according to claim 1, further comprising:

a pair of removable padded arm cushions; and hook and loop fastening material attached to said cushions and the side panels for removably attaching said cushions to the side panels.

6. The article of furniture according to claim 1, wherein the front wall of said mattress supporting assembly has an opening for a drawer defined therein, the article of furniture further comprising:

a drawer insertable in said drawer opening, said drawer having a front face with a horizontal groove in a top surface of said front face; and wherein said front side rail assembly has a pair of side members having tracks defined therein for slidably engaging the vertical ridges on said side panels and a bottom member having a tongue engaging the groove in the front face of said drawer for prevention of further downward movement of said front side rail assembly.

7. The article of furniture according to claim 1, wherein:

said front side rail assembly has spaced vertical slats; and the rear side rail assembly of said frame assembly has vertical slats spaced apart in staggered relation to the vertical slats of said front side rail assembly and being offset rearward from said rear side rail assembly, so that said front side rail assembly is capable of being attached to the rear side rail of said frame assembly with the vertical slats interleaved for storage when the article of furniture is configured as a loveseat.

8. The article of furniture according to claim 1, wherein said frame assembly supports a seat cushion and back cushions.

9. The article of furniture according to claim 1, wherein said mattress supporting assembly has four corner support legs.

10. The article of furniture according to claim 1, wherein said frame assembly has four corner support legs.

11. The article of furniture according to claim 1, wherein said registration means includes a pair of female dovetail grooved elements attached to the side walls of said mattress support assembly for receiving a fastener for setting said frame assembly at a selected height with respect to said mattress supporting assembly.

12. The article of furniture according to claim 11, wherein said registration means further includes a pair of male dove-tail elements slidable in said female dovetail grooved elements, said female dovetailed grooved elements and said male dovetail elements having a plurality of apertures defined therein at predetermined heights for receiving fasteners for setting said frame assembly at a selected height with respect to said mattress supporting assembly.

* * * * *